US005906026A

United States Patent [19]

Junttila

[11] Patent Number: 5,906,026

[45] Date of Patent: May 25, 1999

[54] HOLD-OPEN DEVICE FOR A DOOR

[75] Inventor: Jaakko Junttila, Joensuu, Finland

[73] Assignee: Abloy Oy, Joensuu, Finland

[21] Appl. No.: 08/924,724

[22] Filed: Aug. 29, 1997

[30] Foreign Application Priority Data

Sep. 2, 1996 [FI] Finland ..... 963416

[51] Int. Cl.[6] ..... E05F 5/06; E05F 3/00

[52] U.S. Cl. ..... 16/85; 16/82; 16/65; 16/DIG. 10; 16/DIG. 17; 49/407

[58] Field of Search ..... 16/85, 80, 82, 16/86 B, 70, 71, 72, 65, DIG. 10, DIG. 17; 292/266–270, 275, 277, 278; 49/407

[56] References Cited

U.S. PATENT DOCUMENTS

| | | | |
|---|---|---|---|
| 2,277,316 | 3/1942 | Garrison | 16/DIG. 10 |
| 3,407,434 | 10/1968 | Scott | 16/197 |
| 4,751,766 | 6/1988 | Fahs et al. | 16/86 A |
| 4,788,744 | 12/1988 | Warner | 16/85 |
| 4,858,272 | 8/1989 | Ogawa et al. | 16/80 |
| 5,311,642 | 5/1994 | Tillmann et al. | 16/86 B |

FOREIGN PATENT DOCUMENTS

| | | |
|---|---|---|
| 0 321 649 | 6/1989 | European Pat. Off. . |
| 36 04 083 | 8/1987 | Germany . |
| 38 06 662 | 9/1988 | Germany . |
| 93 06 539 U | 8/1993 | Germany . |

*Primary Examiner*—Chuck Y. Mah
*Attorney, Agent, or Firm*—Smith-Hill and Bedell

[57] ABSTRACT

A hold-open device for a door provided with a closing mechanism comprises an operating arm connectable at one end to the closing mechanism, a guide track, a sliding unit movable in the guide track and connected to the opposite end of the operating arm, and a retainer unit mounted in the guide track. The retainer unit includes a body part held in the guide track at a selectively adjustable position therealong, a holder piece turnably journalled at one end region to the body part, a spring urging the holder piece toward a position in which its opposite end region can engage the sliding unit, and an adjustment member effective between the body part and the holder piece for limiting turning movement of the holder piece relative to the body part.

16 Claims, 2 Drawing Sheets

HOLD-OPEN DEVICE FOR A DOOR

BACKGROUND OF THE INVENTION

The invention relates to a hold-open device for a door or similar wing member.

In a modern hold-open device for a door one should be able to adjust both the hold-open force for the door and the hold-open angle of the door. In addition, when necessary, one should be able to open the door beyond the selected hold-open angle (which is assumed to be less than about 180°) preferably by only exerting additional force. Further, when desired, one should be able to entirely disconnect the hold-open device from operation.

A hold-open device meeting these requirements is shown in the patent publication DE 3604083. However, this known hold-open device is rather complicated both as to its construction and its adjustments, since for instance the adjustment of the hold-open force and the disconnection of the hold-open device from operation are carried out by separate means.

SUMMARY OF THE INVENTION

An aim of the invention is to provide an improved hold-open device of the kind described above, which is constructionally simple and easy to install and to adjust.

In accordance with the invention the holder piece is at one end turnably journalled to the body part of the retainer unit and the retainer unit is provided with an adjustment member, which limits the turning movement of the holder piece relative to the body part of the retainer unit and thereby determines the pre-stress of the spring member. This construction of hold-open device requires only a small number of parts. Also a stepless adjustment of the hold-open force for the door can be provided simply through one adjustment member, by means of which the hold-open device can also be totally disconnected from operation when desired.

From the viewpoint of the operation of the hold-open device it is advantageous that the holder piece has an at least substantially flat sliding surface, which is arranged to smoothly guide the sliding unit into the hold-open position. By adjusting the turning angle of the holder piece the mutual cooperation between this sliding surface and the sliding unit can be affected.

From the viewpoint of the operation and the dimensioning of the spring member it is advantageous that the spring member is located at the end of the holder piece opposite to the journalled end so that it urges the holder piece against the sliding unit. The adjustment member can be located between the journalled end of the holder piece and the spring member. Alternatively it could be located on the other side of the spring member by slightly redesigning the end of the holder piece.

The adjustment member comprises with advantage a screw extending through the holder piece and in threaded engagement with the body part of the retainer unit.

The adjustment of the hold-open angle of the door can be accomplished in simple manner by moving the retainer unit relative to the guiding track.

In practice the guide structure is advantageously of casing-like structure, i.e. it is partially enclosed, and has guiding surfaces against which the sliding unit is urged by the spring member acting against the holder piece.

BRIEF DESCRIPTION OF THE DRAWINGS

In the following the invention is described by way of example with reference to the drawing, in which.

DETAILED DESCRIPTION

Figure 1:
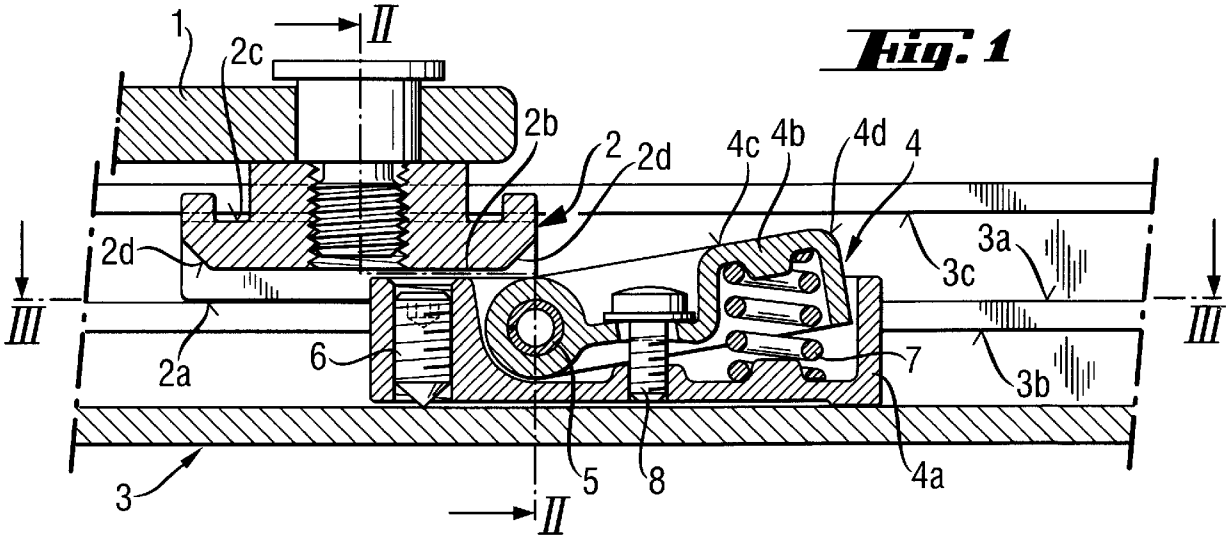
FIG. 1 shows an embodiment of a hold-open device according to the invention in a lengthwise section in a position, in which the hold-open device is not yet in operation.
Figure 2:
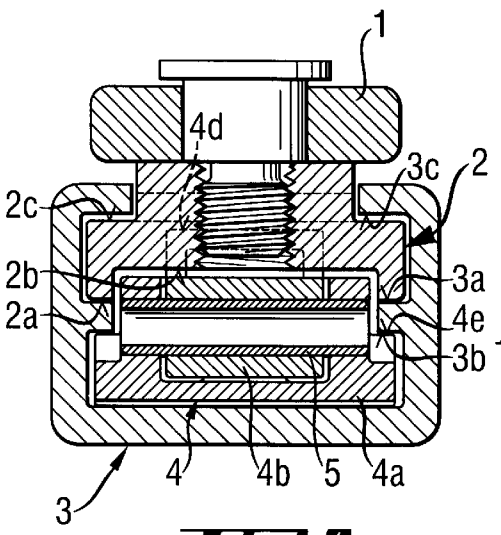
FIG. 2 shows section II—II of FIG. 1.
Figure 3:
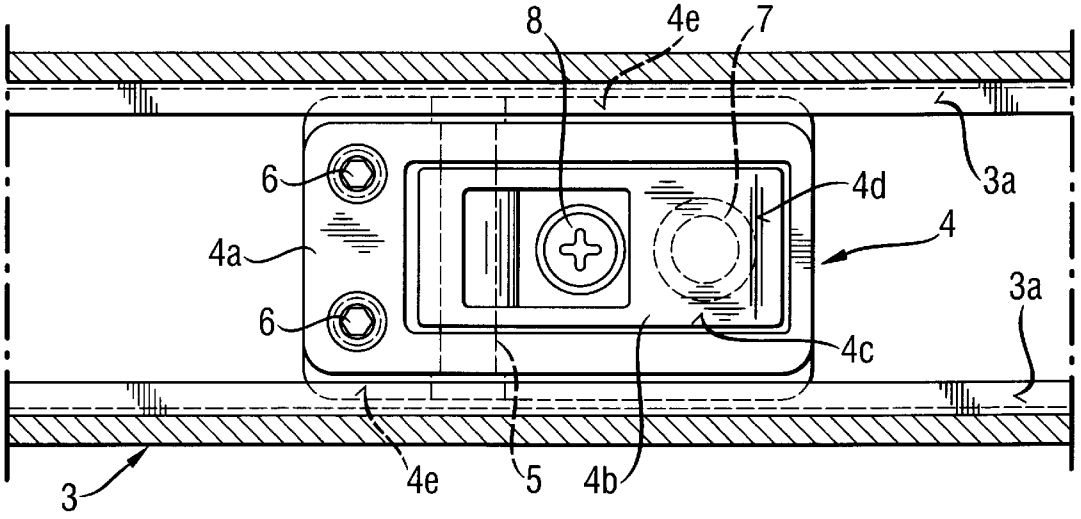
FIG. 3 shows section III—III of FIG. 1.

In the drawing 1 indicates an operating arm, which is connectable to a door closer (not shown) controlling movement of a turnable door or other wing member relative to a frame (not shown). The arm 1 is turnably journalled to a sliding unit 2, which moves back and forth in accordance with the movements of the door in a casing-like guiding track 3 via guiding surfaces 2*a* and 3*a*.

The hold-open device includes a retainer unit 4 which is fitted in the guiding track 3 and comprises a body part 4*a* and a holder piece 4*b* turnably journalled thereto by means of a shaft 5. The body part 4*a* is secured at a certain position along the guiding track 3 by means of screws 6. When the screws 6 are tightened, guiding parts 4*e* of the body part 4*a* of the retainer unit are tightly pressed against guiding surfaces 3*b* of the guiding track 3 and the retainer unit 4 is held in position. The hold-open angle depends on the position of the retainer unit 4 along the track 3. The hold-open angle of the door can be adjusted by loosening the screws 6 and changing the position of the retainer unit 4 along the guiding track 3.

The operation of the hold-open device is based on the cooperation between the retainer unit 4 and the sliding unit 2, whereby when the door is opened the sliding unit 2 moves along the guiding track 3 beyond the retainer unit 4. For this purpose the retainer unit 4 is provided with a spring 7, which urges the holder piece to turn in the counterclockwise direction seen in FIG. 1, and an adjustment screw 8, which limits the turning angle of the holder piece 4*b* relative to the body part 4*a* of the retainer unit. The turning angle of the holder piece 4*b* determines the pre-stress of the spring 7, which affects the hold-open force of the device. Therefore, the screw 8 can be used to adjust the hold-open force according to the size and weight of the door in each case and the strength of the door users. When desired the hold-open device may also be operationally disconnected simply by tightening the adjustment screw 8 so that the sliding unit 2 can slide unobstructed beyond the retainer unit 4 in the guiding track 3.

FIG. 1 illustrates the arrangement when the door is approaching, but has not yet reached, the desired hold-open angle. As the door is opened farther, the sliding unit engages the holder piece, and forces are generated urging the sliding unit upward and urging the holder piece to turn in the clockwise direction. Upward movement of the sliding unit 2 is limited by engagement of the surfaces 2*c* of the sliding unit with the surfaces 3*c* of the track 3. Consequently, the holder piece is forced to turn in the clockwise direction against the force of the spring.

Figure 4:
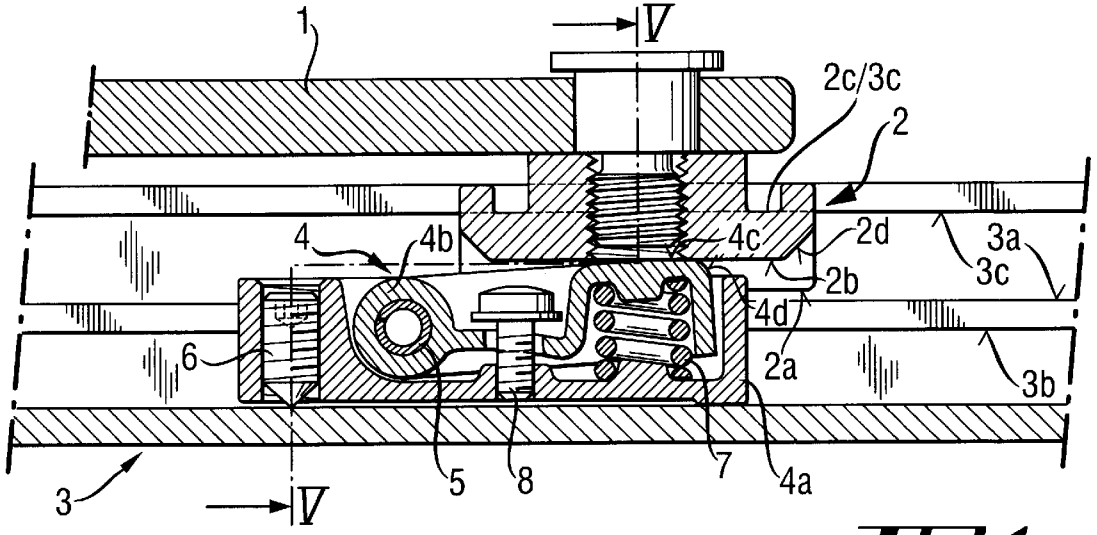
FIG. 4 shows the hold-open device of FIG. 1 slightly before the actual hold-open position.
Figure 5:
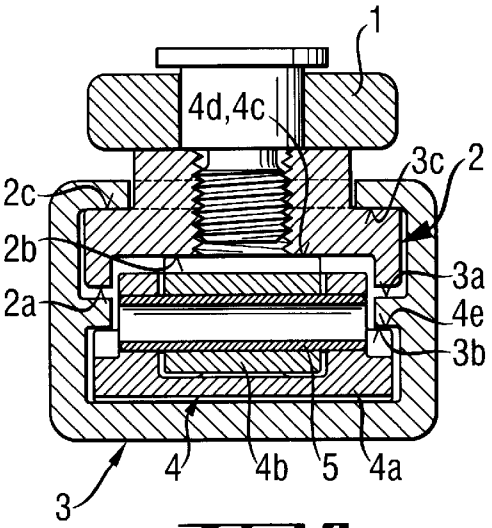
FIG. 5 shows section V—V of FIG. 4.
Figure 6:
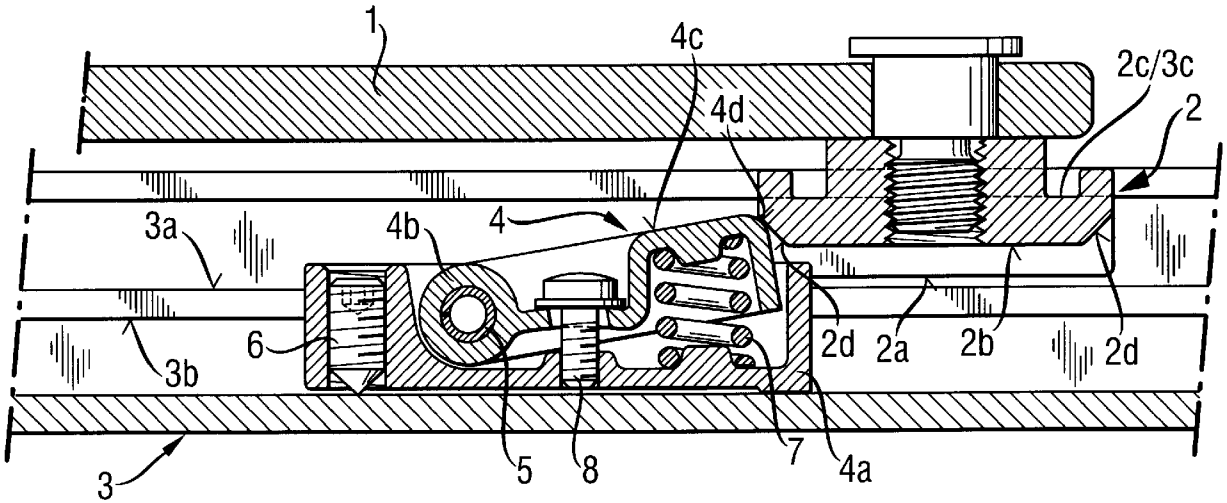
FIG. 6 shows the hold-open device of FIG. 1 in a position, in which the device holds the door open in a selected hold-open angle.

FIG. 4 shows the hold-open device when the sliding unit 2 has reached the position of the retainer unit 4 and upon continued opening of the door slides further beyond it, whereby a surface 2*b* of the sliding unit 2 engages a surface 4*c* of the holder piece 4*b*. At the same time the spring 7 urges the sliding unit 2 through the holder piece 4*b* upwards in the figure so that the surfaces 2*c* of the sliding unit 2 and the surfaces 3*c* of the guiding track 3 come into contact as well. So the sliding unit 2 is guided smoothly beyond the retainer unit 4 against a resistance that depends on the coefficient of friction between on the one hand the surfaces 2*b* and 4*c* and on the other hand the surfaces 2*c* and 3*c*, the spring force of the spring 7 and the turning angle of the holder piece 4*b*. When the sliding unit 2 attains the position shown in FIG. 6, the hold-open device keeps the door in the selected hold-open position determined by the position of the retainer unit 4. From this position the door can freely be turned further toward its fully open position.

By exerting sufficient force the sliding unit 2 can be moved back beyond the retainer unit 4 in order to close the door. As already noted above the hold-open force can be adjusted by means of the adjustment screw 8. For providing a more smooth movement of the sliding unit 2 beyond the holder piece 4*b* the edges of the sliding unit 2 have bevelled parts 2*d* and the edge of the holder piece 4*b* is rounded at 4*d*. Then the closing force is influenced not only by the turning position of the holder piece 4*b*, as set by the adjustment screw 8, but also by the coefficient of friction between the surfaces 2*c* and 3*c* and on the other hand the surfaces 2*d* and 4*d*.

The invention is not limited to the embodiment shown, but several modifications are feasible within the scope of the attached claims.

I claim:

1. A hold-open device for a wing member that is turnable relative to a frame structure and is provided with a closing mechanism for turning the wing member to a closed position, comprising:

an operating arm connectable at one end to the closing mechanism, a guide structure defining an elongate guide track, a sliding unit movable in the guide track and connected to an opposite end of the operating arm, and a retainer unit mounted in the guide track, the retainer unit including a body part held in the guide track at a selectively adjustable position therealong, a holder piece having first and second opposite ends and turnably journalled to the body part at said first end, a prestressed spring member urging the holder piece toward a position in which a region of the holder piece neighboring the second end thereof can engage the sliding unit, and an adjustment member effective between the body part and the holder piece for limiting turning movement of the holder piece relative to the body part and simultaneously determining the prestress of the spring member.

2. A hold-open device according to claim 1, wherein the holder piece has a substantially flat sliding surface which smoothly guides the sliding unit past the retainer unit to a hold-open position.

3. A hold-open device according to claim 1, wherein the spring member acts between the body part of the retainer unit and said region of the holder piece.

4. A hold-open device according to claim 1, wherein the adjustment member is located between the first end of the holder piece and the spring member.

5. A hold-open device according to claim 1, wherein the adjustment member is a screw which extends through the holder piece and is in threaded engagement with the body part of the retainer unit.

6. A hold-open device according to claim 1, comprising a securing means for securing the retainer unit at a selected position lengthwise of the guide track.

7. A hold-open device according to claim 6, wherein the securing means is releasable for adjusting the position of the retainer unit lengthwise the guide track.

8. A hold-open device according to claim 1, wherein the guide structure includes a portion which retains the sliding unit captive in the guide track while permitting movement of the sliding unit lengthwise of the guide track.

9. A hold-open device according to claim 8, wherein said portion of the guide structure has a guiding surface against which the sliding unit is forced by the spring member acting against the holder piece.

10. A hold-open device for a wing member that is turnable relative to a frame structure and is provided with a closing mechanism for turning the wing member to a closed position, comprising:

an operating am connectable at one end to the closing mechanism, a guide structure defining an elongate guide track, a sliding unit movable in the guide track and connected to an opposite end of the operating arm, and a retainer unit mounted in the guide track, the retainer unit including a body part held in the guide track at a selectively adjustable position therealong, a holder piece having first and second opposite ends and turnably journalled to the body part at said first end, a prestressed spring member urging the holder piece toward a position in which a substantially flat sliding surface neighboring the second end of the holder piece can engage the sliding unit for smoothly guiding the sliding unit past the retainer unit to a hold-open position, and a screw which extends through the holder piece and is in threaded engagement with the body part of the retainer unit for limiting turning movement of the holder piece relative to the body part and simultaneously determining the prestress of the spring member.

11. A hold-open device according to claim 10, wherein the spring member acts between the body part of the retainer unit and said region of the holder piece.

12. A hold-open device according to claim 10, wherein the screw is located between the first end of the holder piece and the spring member.

13. A hold-open device according to claim 10, comprising a securing means for securing the retainer unit at a selected position lengthwise of the guide track.

14. A hold-open device according to claim 13, wherein the securing means is releasable for adjusting the position of the retainer unit lengthwise the guide track.

15. A hold-open device according to claim 10, wherein the guide structure includes a portion which retains the sliding unit captive in the guide track while permitting movement of the sliding unit lengthwise of the guide track.

16. A hold-open device according to claim 15, wherein said portion of the guide structure has a guiding surface against which the sliding unit is forced by the spring member acting against the holder piece.

* * * * *